US005177817A

United States Patent [19]

Kamata

[11] Patent Number: 5,177,817

[45] Date of Patent: Jan. 12, 1993

[54] SHIELD MOUNTING STRUCTURE IN HELMET

[75] Inventor: Eitaro Kamata, Tokyo, Japan

[73] Assignee: Shoei Kako Kabushiki Kaisha, Tokyo, Japan

[21] Appl. No.: 808,401

[22] Filed: Dec. 16, 1991

[30] Foreign Application Priority Data

May 31, 1991 [JP] Japan ..... 2-130064

[51] Int. Cl.[5] ..... A42B 1/08

[52] U.S. Cl. ..... 2/424

[58] Field of Search ..... 2/9, 410, 422, 424, 2/425

[56] References Cited

U.S. PATENT DOCUMENTS

| | | | |
|---|---|---|---|
| 4,866,792 | 9/1989 | Arai | 2/424 |
| 4,920,585 | 5/1990 | Arai | 2/424 |
| 5,005,221 | 4/1991 | Chen | 2/424 |
| 5,073,990 | 12/1991 | Kamata | 2/424 |
| 5,091,997 | 3/1992 | Foehl | 2/424 |
| 5,095,551 | 3/1992 | Chin | 2/424 |

FOREIGN PATENT DOCUMENTS

| | | | |
|---|---|---|---|
| 223139 | 5/1987 | European Pat. Off. | 2/424 |
| 111037 | 4/1989 | Taiwan . | |
| 120543 | 10/1989 | Taiwan . | |

*Primary Examiner*—Werner H. Schroeder
*Assistant Examiner*—Michael A. Neas
*Attorney, Agent, or Firm*—Armstrong, Westerman, Hattori, McLeland & Naughton

[57] ABSTRACT

In a helmet, a cylindrical pivot is projectingly provided on an outer surface of a mounting base secured to left and right outer sides of a cap body. A first bayonet mechanism is provided between the pivot and an end of a shield having a pivot hole fitted over the pivot, and a second bayonet mechanism is provided between the pivot and an end cover covering the end of the shield to retain it. When the end cover is pivoted to a coupling position of the second bayonet mechanism, a projection of a resilient locking arm integral with the mounting base is automatically engaged into a retaining hole in the end cover. The shield can be mounted to the cap body without use of any screws and by a simple structure.

5 Claims, 8 Drawing Sheets

SHIELD MOUNTING STRUCTURE IN HELMET

BACKGROUND OF THE INVENTION

1. Field of the Invention

The field of the present invention is shield mounting structures in helmets of the type for mounting the shield to the mounting base secured to the outer surface of the cap body, such that the shield can be pivoted to open and close the window of the cap body.

2. Description of the Prior Art

In a prior art shield mounting structure of such a type, screws such as machine screws and covers are used to prevent the shield from falling off from the mounting base (for example, see Japanese Laid-open Utility Model Application No. 15314/88).

In general, in a helmet, the shield may be replaced by a clear type shield, a sun-shade type shield or the like, depending upon the preference of a user or conditions for use. With the above prior art structure, removal and attaching of the screws must be carried out for every replacement, and the operation therefor is troublesome.

SUMMARY OF THE INVENTION

Accordingly, it is an object of the present invention to provide a simple shield mounting structure by which a shield can be readily mounted to the mounting base without use of any screws.

To achieve the above object, according to the present invention, there is provided a shield mounting structure in a helmet for mounting a shield to a mounting base secured to an outer surface of a cap body, such that the shield can be pivoted to open or close a window, comprising a pivot provided at an end portion of the mounting base, a pivot hole provided in an end portion of the shield, the pivot hole being pivotally fitted to the pivot, a first bayonet mechanism provided between the pivot and the shield for separably coupling the pivot and the shield, an end cover pivotally carried on the pivot to cover the end portion of the shield, a second bayonet mechanism provided between the end cover and the pivot for separatably coupling the end cover and the pivot, and a resilient locking arm integrally formed on the mounting base, and adapted to be resiliently brought into engagement with a retaining portion of the end cover when said end cover has been pivoted to a coupling position of the second bayonet mechanism.

With the above construction of the present invention, if the end of the shield is first coupled to the pivot of the mounting base through the first bayonet mechanism, and the end cover for covering the end of the shield is then coupled to the pivot through the second bayonet mechanism, a locking mechanism can automatically be operated to lock the end cover at the coupling position of the second bayonet mechanism. This ensures that the shield can be extremely simply mounted to the cap body without use of any screws. Moreover, even if one of the first and second bayonet mechanisms should be failed, the shield still can be retained on the pivot, as long as the other bayonet mechanism is normal, leading to a high reliability. Further, an exclusive locking member and a locking spring separate from the mounting base are not required for the locking mechanism. Therefore, it is possible to provide an extremely simple shield mounting structure in a helmet with an inexpensive cost.

The above and other objects, features and advantages will become apparent from a consideration of the following description of the preferred embodiments, taken in conjunction with the accompanying drawings.

BRIEF DESCRIPTION OF THE DRAWINGS

Drawings illustrate a preferred embodiment of the present invention, wherein.

DESCRIPTION OF THE PREFERRED EMBODIMENTS

The present invention will now be described by way of a preferred embodiment in connection with the accompanying drawings.

Figure 1:
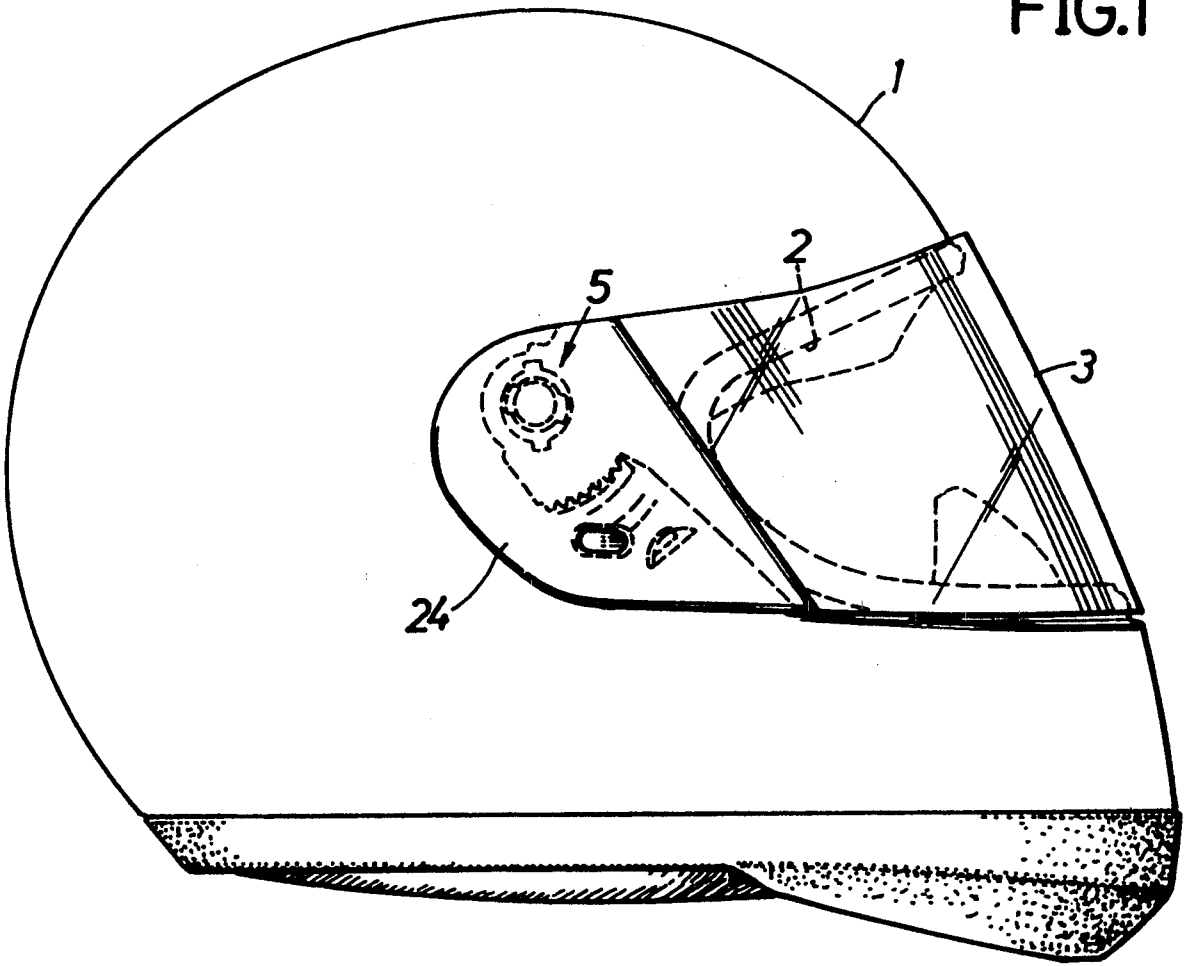
FIG. 1 is a side view of a helmet.

Referring first to FIG. 1, a shield 3 is pivotally mounted at its left and right end portions to left and right sidewalls of a cap body 1 of a full-face type helmet by a mounting structure 5 of the present invention for vertical pivotal movement to open and close a window 2 opened into a front wall of the cap body 1. The shield 3 is formed from transparent or light-permeable synthetic resin used as a material.

Figure 2:
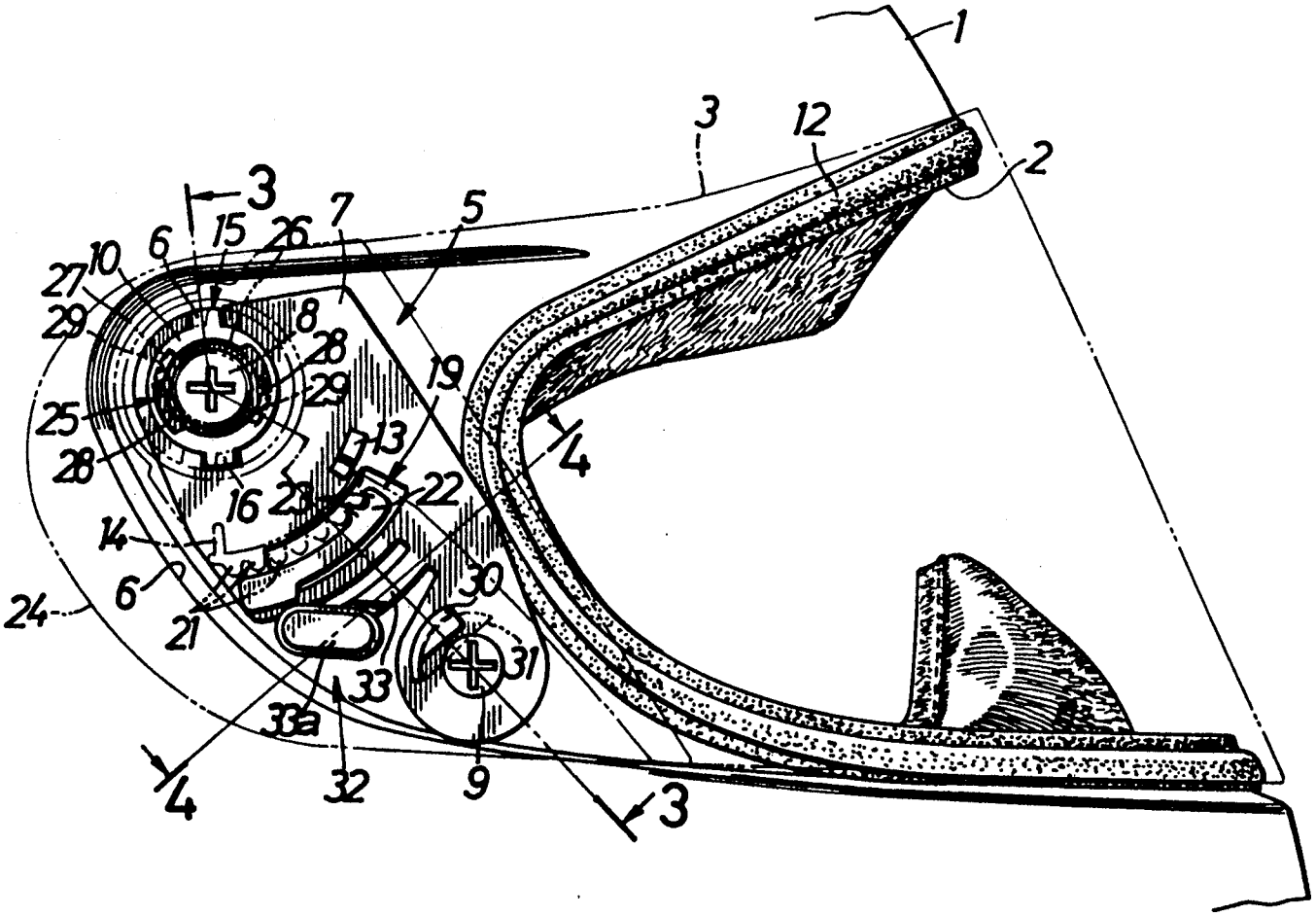
FIG. 2 is an enlarged side view of a shield mounting structure portion shown in FIG. 1 with a shield removed.
Figure 3:
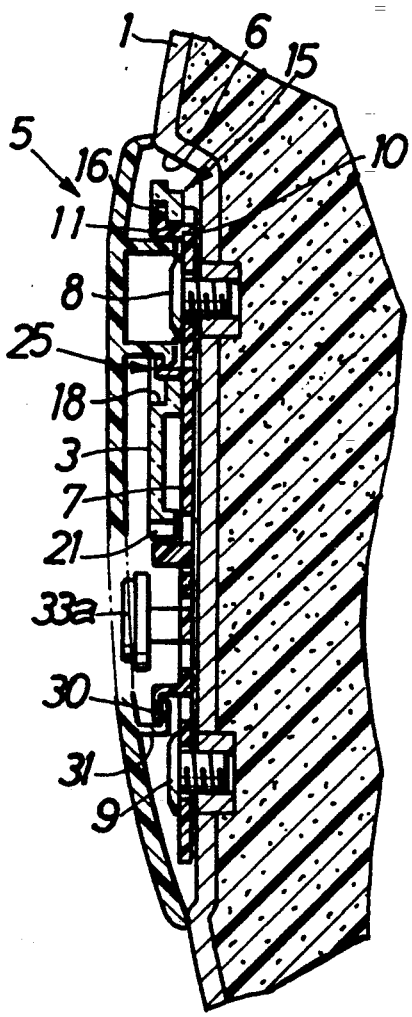
FIG. 3 is a sectional view taken along a line 3—3 in FIG. 2.

The mounting structure 5 will be described below with reference to FIGS. 2 to 5. As shown in FIGS. 2 and 3, a shallow recess 6 is provided in each of left and right outer sides of cap body 1 (only the right side is shown in Figures), and a mounting base 7 of synthetic resin is secured to a bottom surface of the recess 6 at two, upper and lower points by machine screws 8 and 9.

Figure 5:
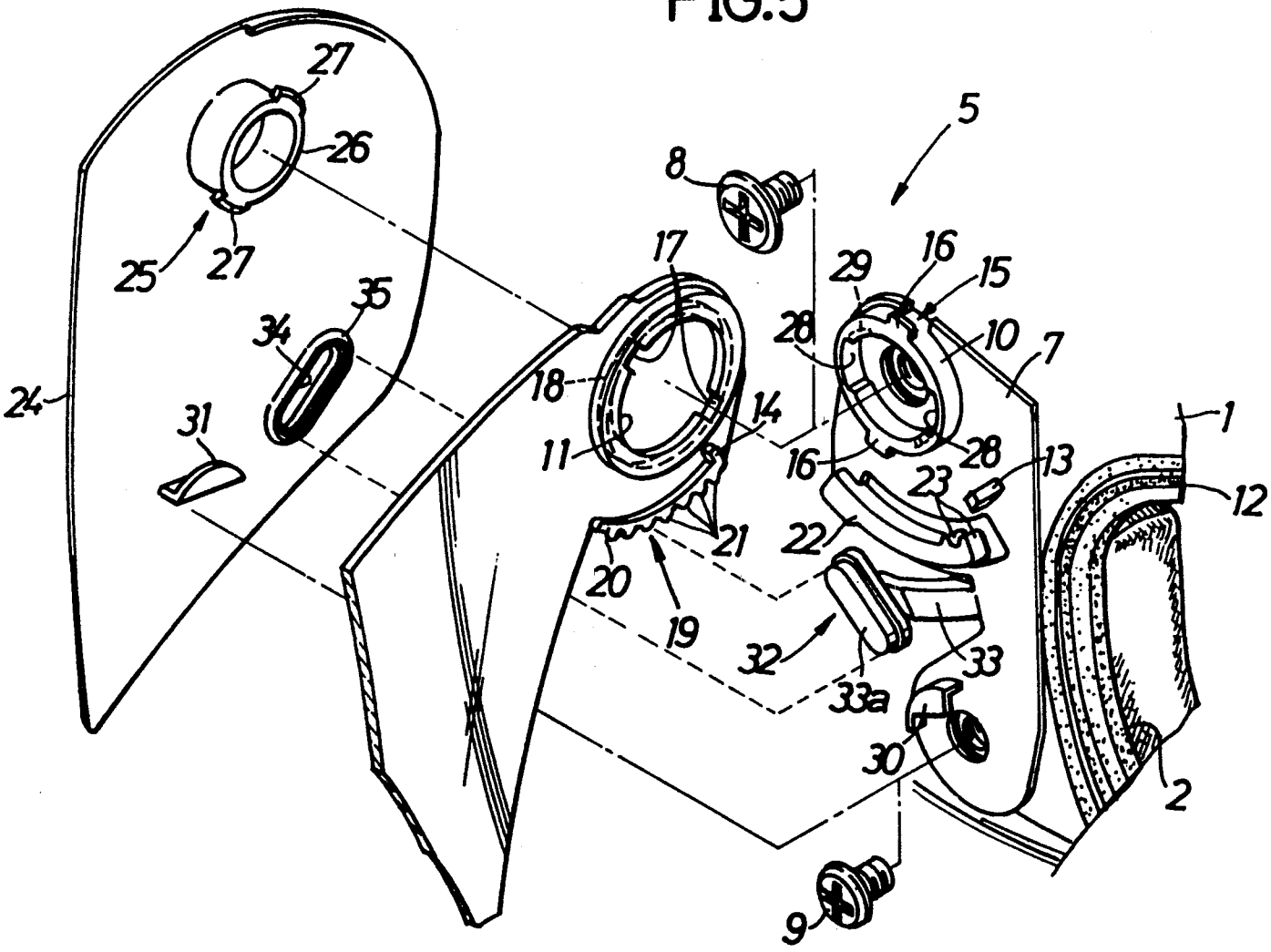
FIG. 5 is an exploded perspective view of a shield mounting structure.

As shown in FIGS. 2, 3 and 5, a cylindrical pivot 10 is integrally projected on an outer surface of the mounting base 7 to surround the upper machine screw 8, and a pivot hole 11 provided in an end of the shield 3 is rotatably fitted over the pivot 10. The shield 3 can be pivotally moved about the pivot 10 between a fully closed position in which it comes into close contact with a sealing member 12 attached to a peripheral edge of the window 2 and a fully opened position in which the window 2 is fully opened. The fully opened position of the shield 3 is defined by abutment of stoppers 13 and 14 projectingly mounted on opposed surfaces of the mounting base 7 and the shield 3 against each other.

A first bayonet mechanism 15 is formed between the pivot 10 and the shield 3 for separatably coupling the pivot 10 and the shield 3. More specifically, a pair of connecting pawls 16, 16 are integrally projected on an outer periphery of a tip end of the pivot 10 and arranged the opposite sides on a diametrical line of the pivot 10, while a pair of notches 17, 17 are provided in a peripheral edge of the pivot hole 11 in the shield 3, such that the connecting pawls 16, 16 can be passed through the notches 17, 17. Further, an annular recess 18 is provided in the outer surface of the shield 3 and capable of receiving the connecting pawls 16, 16 passed through the notches 17, 17.

The pivot 10 and the pivot hole 11 can be fitted with and released from each other in a position in which the connecting pawls 16, 16 are alinged with the notches 17, 17, and are coupled with each other by engagement of the connecting pawls 16, 16 into the annular recess 18.

A click stop mechanism 19 is provided between the mounting base 7 and the shield 3 for retaining the shield 3 at the fully closed and opened positions and for providing multiple intermediate stop positions to the shield 3 in a range of pivotal movement of the shield 3. This mechanism 19 is comprised of a large number of click teeth 21, 21 - - - formed on that lower thick edge 20 of an end of the shield 3 which is arcuate about the pivot hole 11, and a resilient retaining arm 22 integrally formed on the mounting base 7. The retaining arm 22 is disposed to extend longitudinally across the center between the upper and lower machine screws 8 and 9, and has its rear end integral with the mounting base 7 and the remaining portion separated from the mounting base 7, thereby providing a resilient force directed toward the click teeth 21, 21. The retaining arm 22 is provided at its front or free end with a single or several click teeth 23 which can be selectively meshed with the click teeth 21, 21 - - - .

Figure 6:
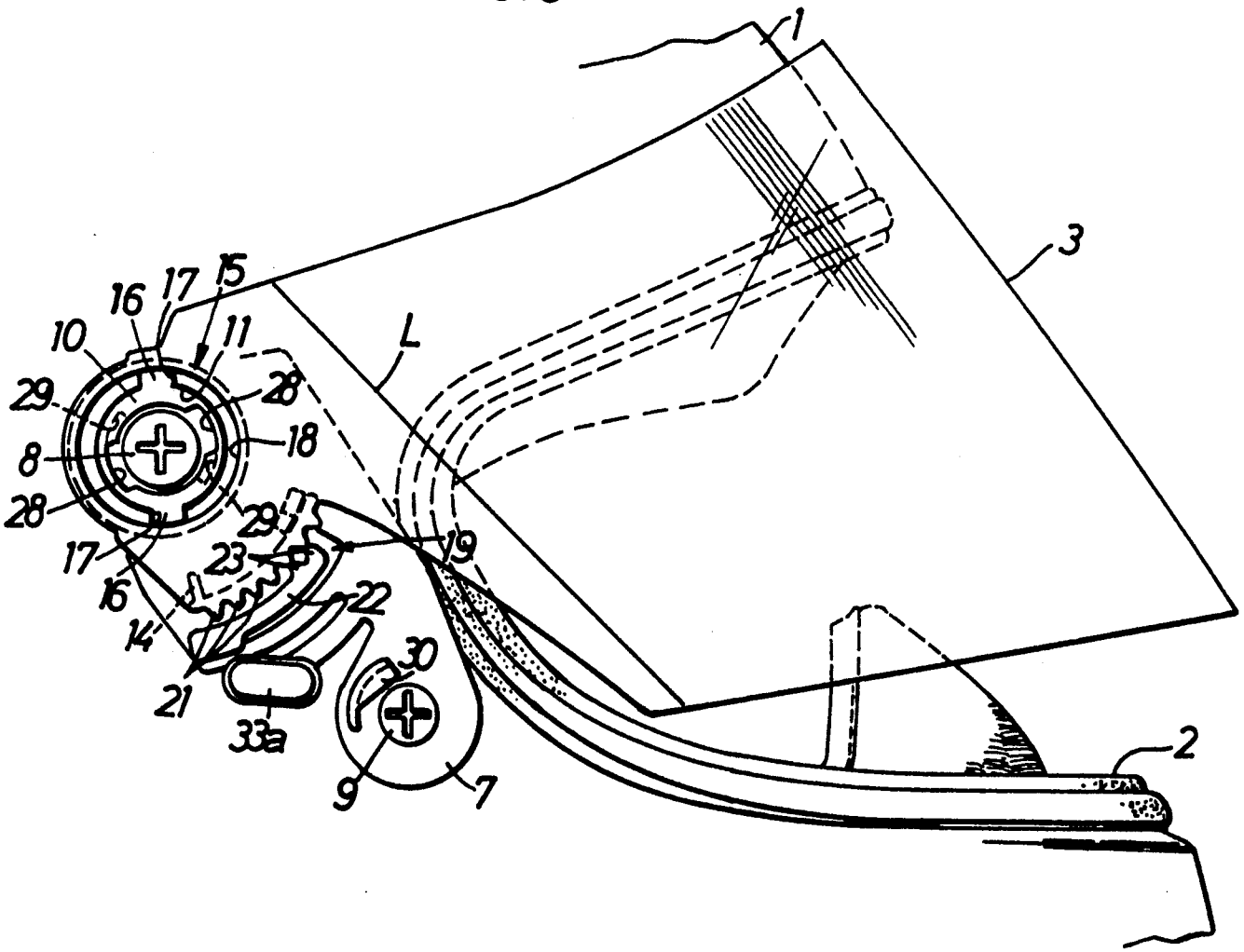
FIG. 6 is a view illustrating a shield set at a separating position of a first bayonet mechanism for explaining the operation.

It should be noted that a separating position of the first bayonet mechanism 15, i.e., a position in which the connecting pawls 16, 16 are aligned with the notches 17, 17 is set to correspond to an incompletely meshed condition in which the click tooth 23 is located in a top to top relationship with respect to a predetermined one of the click teeth 21, 21 - - - in the click stop mechanism 19, as shown in FIG. 6.

In order to prevent the shield 3 from being separated from the pivot 10 even in the separating position of the first bayonet mechanism 15, an end cover 24 of synthetic resin is connected to the pivot 10 through a second bayonet mechanism 25 for covering the outer side of the end of the shiled 3 to retain it.

The second bayonet mechanism 25 is comprised of a connecting shaft 26 integrally projected on an inner surface of the end cover 24 and rotatably received into the cylindrical pivot 10, a pair connecting pawls 27, 27 projected on an outer periphery of a tip end of the connecting shaft 26 and arranged on the opposite sides on a diametrical line of the connecting shaft 26, a pair of notches 28, 28 provided in an inner peripheral surface of the pivot 10, so that the connecting pawls 27, 27 can be passed through the notches, and connecting grooves 29, 29 each extending through a given angle in a direction of closing pivotal movement of the shield 3 from one end wall of each of the notches 28, 28. The connecting grooves 29, 29 are adapted to be able to receive the connecting pawls 27, 27 which have passed through the notches 28, 28.

The pivot 10 and the connecting shaft 26 can be fitted with and released from each other in a position in which the connecting pawls 27, 27 are aligned with the notches 28, 28, and they are coupled with each other by engagement of the connecting pawls 27, 27 into the connecting grooves 29, 29.

It should be noted that in order to know the separating position of the second bayonet mechanism 25, i.e., the position of alignment of the connecting pawls 27, 27 with the notches 28, 28 even if the end cover 24 is opaque, a reference line mark L is provided on the outer surface of the shield 3. This mark L is adapted to be aligned with a rectilinear front edge **24*a* of the end cover 24 when the shield 3** has been retained at a predetermined intermediate stop position (a fourth intermediate stop position from the fully closed position in this embodiment).

Figure 4:
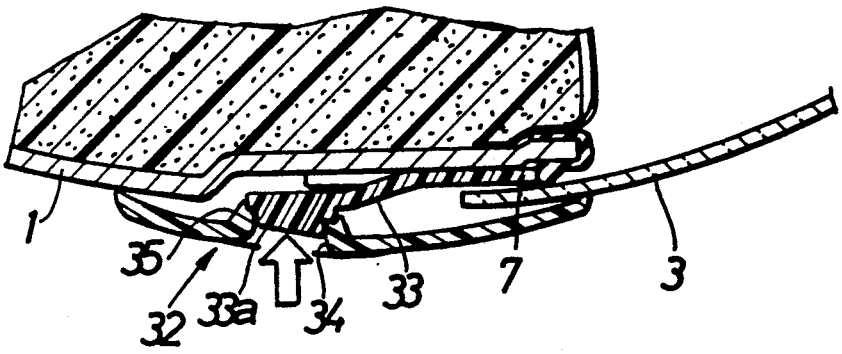
FIG. 4 is a sectional view taken along a line 4—4 in FIG. 2.
Figure 8:
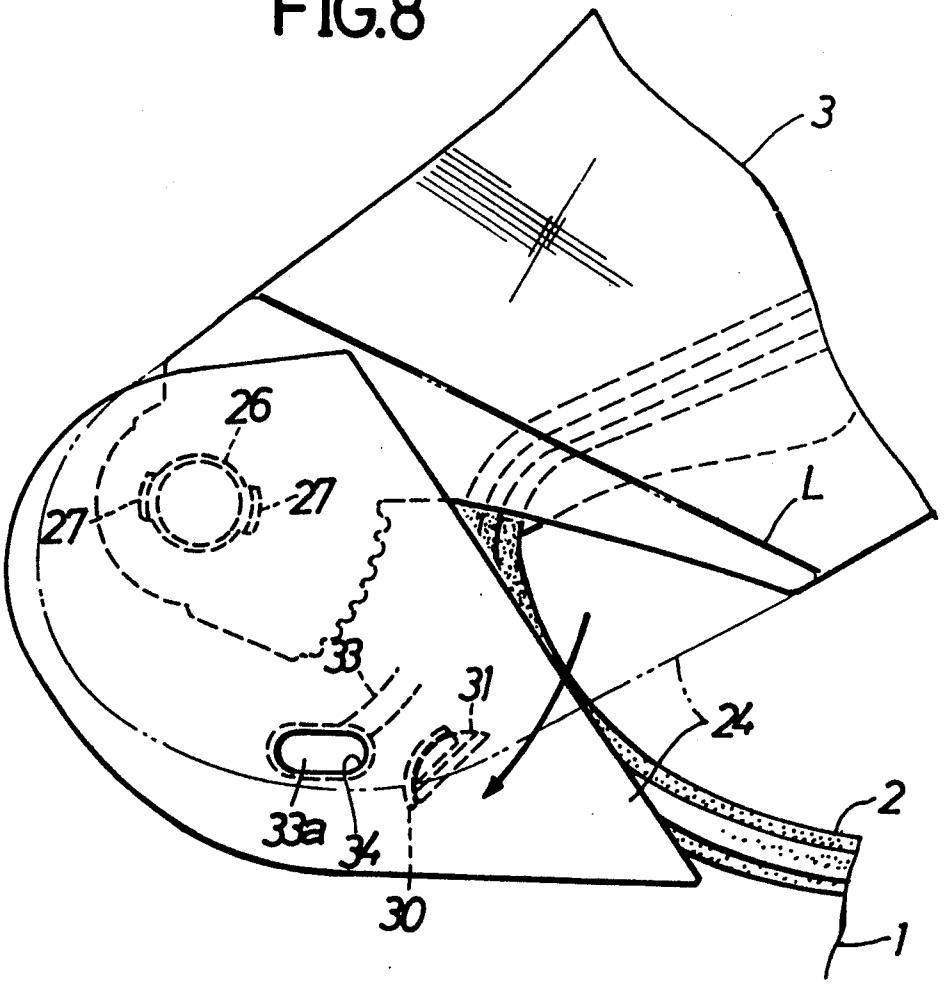
FIG. 8 is a view illustrating the end cover pivoted to a service position (locked state) for explaining the operation.

If the end cover 24 is pivoted in a direction of closing pivotal movement of the shield 3 from the separating position of the second bayonet mechanism 25 to a service position shown in FIG. 8, the connecting pawls 27, 27 are brought into engagement into the connecting grooves 29, 29 to bring the second bayonet mechanism 25 into a coupling state. The service position of the end cover 24 is defined by engagement of engage pawls 30 and 31 integrally provided on opposed surfaces of lower portions of the mounting base 7 and the end cover 24 with each other. As shown in FIGS. 4 and 5, a locking mechanism 32 is formed between the mounting base 7 and the end cover 24 for locking the end cover 24 at the service position. The locking mechanism 32 is comprised of a resilient locking arm 33 integrally formed on the mounting base 7, and an elliptic retaining hole 34 (retaining portion) provided through the end cover 24. The locking arm 33 is disposed to extend longitudinally between the retaining arm 22 and the lower machine screw 9. A front end of the locking arm 33 is integrally formed with the mounting base 7 and the remaining portion of the arm 33 is separated from the mounting base 7, thereby providing a resilient force directed toward the end cover 24. The locking arm 33 is provided at its rear or free end with an elliptic projection **33*a* which can be fitted into the retaining hole 34 in the service position of the end cover 24. On the other hand, a tapered annular protruding wall 35 is formed on an inner surface of the end cover 24 and connected to a peripheral edge of the retaining hole 34. The protruding wall 33*a* is adapted to be kept sunk from the outer surface of the end cover 24 in a position in which it is fitted into the retaining hole 34**.

The operation of this embodiment will be described below.

To mount theshield 3 to the cap body 1, the pivot hole 11 in the shield 3 is first fitted over the pivot 10 of the mounting base 7 in the separating position of the first bayonet mechanism 15, and then, the shield 3 is pivoted either upwardly or downwardly about the pivot 10, so that the first bayonet mechanism 15 assumes the coupling state as described above to inhibit the separation-off of the shield 3 from the pivot 10.

Figure 7:
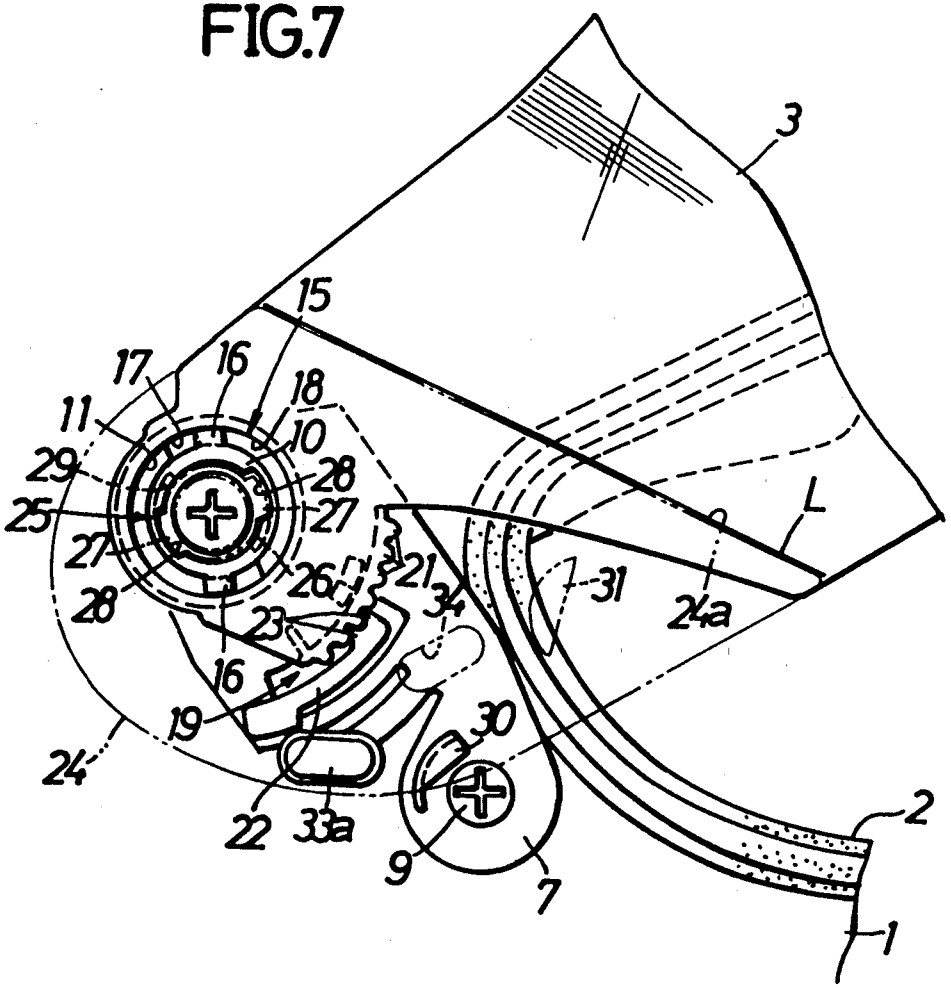
FIG. 7 is a view illustrating an end cover set at a separating position of a second bayonet mechanism for explaining the operation.

Subsequently, as shown in FIG. 7, the connecting shaft 26 of the end cover 24 is fitted into the pivot 10 of the mounting base 7 in the separating position of the second bayonet mechanism 25 and then, the end cover 24 is pivoted to the service position shown in FIG. 8. This pivotal movement causes the second bayonet mechanism 25 to be brought into the coupling state as described above to inhibit the separation-off of the connecting shaft 26 from the pivot 10, while causing the projection **33*a* of the locking arm 33 to move over the annular protruding wall 35 on the inner surface of the end cover 24 to resiliently fit into the retaining hole 34. At this time, the locking pawls 30 and 31 engaged with each other to define the service position of the end cover 24 also serves to prevent the outward floating-up of the lower portion of the end cover 24**.

Thus, the end cover 24 is locked by the locking mechanism 32, so that the second bayonet mechanism 25 is prevented from being returned to the separating position. In this case, the projection 33*a* of the locking arm 33 occupies a position in which it is sunk from the outer surface of the end cover 24 even in the state in which the projection 33*a* is fitted into the retaining hole 34. Therefore, in use, even if the outer surface of the end cover 24 struck against other objects, the projection 33*a* cannot be thereby urged inwardly.

To remove the shield 3 from the cap body 1, the user first puts his or her fingertip into the retaining hole 34 to separate-off the projection 33*a* of the locking arm 33 from the retaining hole 34. Thereafter, the reverse operation to the mounting operation may be carried out.

In the locked state of the end cover 24, the shield 3 is retained to the outer surface by the end cover 24 coupled to the pivot 10 by the second bayonet mechanism 25 and hence, even when the shield 3 has been brought into the separating position of the first bayonet mechanism 15 by the vertical pivotal movement of the shield 3 itself, the pivot 10 will not come out from the pivot hole 11. Moreover, because the separating position of the first bayonet mechanism 15 is established to suit to the incomplete meshing of the click teeth 21 and 23 in the click stop mechanism 19 as described above, the first bayonet mechanism 15 can always maintain the coupled condition in the multiple intermediate stop positions and the fully closed and opened positions in which the shield 3 is retained by a normal meshing of the click teeth 21 and 23. Even if one of the first and second bayonet mechanism 15 or 25 should be failed, it is possible to keep retaining the shield 3 on the pivot 10 by the other normal mechanism, leading to a high reliability.

Further, since the locking mechanism 32 is comprised of the resilient locking arm 33 integral with the mounting base 7, and the retaining hole 34 in the end cover 24, it is unnecessary to use an exclusive locking member or a locking spring separate from the mounting base 7, leading to an extremely simplified structure.

It will be understood that the present invention is not limited to the full-face type helmet, but also applicable to a jet type or other types of helmets.

What is claimed is:

1. A shield mounting structure in a helmet for mounting a shield to a mounting base secured to an outer surface of a cap body, such that the shield can be pivoted to open or close a window, comprising a pivot provided at an end portion of the mounting base, a pivot hole provided in an end portion of the shield, said pivot hole being pivotally fitted to said pivot, a first bayonet mechanism provided between said pivot and said shield for separably coupling said pivot and said shield, an end cover pivotally carried on said pivot to cover the end portion of said shield, a second bayonet mechanism provided between said end cover and said pivot for separatably coupling said end cover and said pivot, and a resilient locking arm integrally formed on said mounting base, and adapted to be resiliently brought into engagement with a retaining portion of said end cover when said end cover has been pivoted to a coupling position of the second bayonet mechanism.

2. A shield mounting structure in a helmet according to claim 1, further including a click stop mechanism provided between said mounting base and said shield for retaining the shield at fully closed and opened positions and multiple intermediate stop positions in a range of pivotal movement, wherein the separation by said first bayonet mechanism can be conducted when said click stop mechanism is in an unstable position between two adjacent stop positions.

3. A shield mounting structure in a helmet according to claim 1 or 2, wherein said first bayonet mechanism comprises a pair of connecting pawls projectingly provided on an outer periphery of a tip end of said pivot and arranged on one diametrical line of the pivot, a pair of first notches provided in a peripheral edge of said pivot hole, so that said first connecting pawls can be passed through the first notches, and an annular groove provided in an outer surface of said shield to receive the first connecting pawls passed through the first notches.

4. A shield mounting structure in a helmet according to claim 3, wherein said second bayonet mechanism comprises a connecting shaft integrally projected on an inner surface of said end cover and capable of being rotatably fitted into said cylindrical pivot, a pair of second connecting pawls projectingly provided on an outer periphery of a tip end of said connecting shaft and arranged on one diametrical line thereof, a pair of second notches provided in an inner peripheral surface of said pivot, so that said second connecting pawls can be passed through said second notches, and connecting grooves extending through a given angle from one end wall of said second notches in a direction of closing pivotal movement of said shield.

5. A shield mounting structure in a helmet according to claim 2, wherein said click stop mechanism comprises a large number of first click teeth formed on a lower thick edge of the end portion of the shield which is arcuate about said pivot hole, a resilient retaining arm integrally formed on said mounting base, one or more second click teeth provided at a free end of said retaining arm and capable of being selectively meshed with said first click teeth, and the separating position of said first bayonet mechanism is set to correspond to an incompletely meshed condition in which both the first and second click teeth are located in a top to top relationship with each other.

* * * * *